US008757356B2

(12) United States Patent
Peterek et al.

(10) Patent No.: US 8,757,356 B2
(45) Date of Patent: Jun. 24, 2014

(54) MEDIA DEPOSITORY

(75) Inventors: Thomas Peterek, Kitchener (CA); Fred Kallin, Waterloo (CA)

(73) Assignee: NCR Corporation, Duluth, GA (US)

( * ) Notice: Subject to any disclaimer, the term of this patent is extended or adjusted under 35 U.S.C. 154(b) by 180 days.

(21) Appl. No.: 13/285,889

(22) Filed: Oct. 31, 2011

(65) Prior Publication Data

US 2013/0105276 A1 May 2, 2013

(51) Int. Cl.
*B65G 47/00* (2006.01)

(52) U.S. Cl.
USPC ..... 198/382; 198/400

(58) Field of Classification Search
USPC ..... 198/382, 400, 374, 377.01, 412, 604, 198/605
See application file for complete search history.

(56) References Cited

U.S. PATENT DOCUMENTS 5,735,516 A * 4/1998 Gerlier et al. ..... 270/60
2007/0205083 A1 * 9/2007 Smalley et al. ..... 198/412

* cited by examiner

*Primary Examiner* — Gene Crawford
*Assistant Examiner* — Lester Rushin
(74) *Attorney, Agent, or Firm* — Michael Chan

(57) ABSTRACT

A method and apparatus are disclosed for providing an aligned bunch of items of media. The apparatus includes a driven drum element arranged to rotate about a drum axis of rotation and at least one driven endless belt member, each arranged along a respective belt pathway. The belt pathway comprises a pathway portion in which the belt member extends in a co-operating relationship with more than sixty percent of the circumference of an outer surface of the drum element. The drum element and at least one belt member co-operate to receive and align items of media therebetween.

16 Claims, 7 Drawing Sheets

MEDIA DEPOSITORY

FIELD OF INVENTION

The present invention relates to an apparatus and method for providing an aligned stack of items of media. In particular, but not exclusively, the present invention relates to the use of a rebuncher in a scalable deposit module. The rebuncher includes a driven drum and driven endless belt which co-operate over a large extent of the circumference of the drum to keep a bunch of items of media such as currency notes aligned as they are stacked prior to their dispatch to a customer.

BACKGROUND TO THE INVENTION

Media depositories are used to receive media items from a customer. One common type of media depository is a sheet media depository for receiving items of media in sheet form. For example, such items of media can be currency notes, checks, tickets, giros or the like.

Sheet media depositories are used in automated teller machines (ATMs) and other self-service terminals. Other such self-service terminals are vending machines, change machines or the like. The sheet media depositories are used to identify, validate and store or return deposited sheets.

Some sheet depositories are capable of receiving a bunch of sheets in a loading area and then picking individual sheets from the bunch so that each sheet can then be identified and validated individually prior to storage of the validated sheet within a depository or returned to a customer. These depositories are sometimes referred to as bunch sheet depositories. Bunch sheet depositories may transport the bunch from a loading area to a picking area or the picking area may be adjacent to the loading area.

It is desirable to provide bunch sheet depositories that can accept a large bunch of sheet items. However, when a large bunch of items has to be returned to a customer, there is a tendency for sheets within the bunch to splay out prior to reaching a dispatch area. The splaying out can cause failure of the machinery if the splaying effect becomes too pronounced. Also, a bunch returned to a customer may be unattractive.

Furthermore, some customers will only insert a small number of sheet items. For example, such as one currency note or a few checks and notes into the bunch sheet depository whereas other customers will insert up to a maximum permissible number of sheets. Most prior art depositories have a maximum bunch allowed of up to fifty items of media. This occasionally unduly limits the transactions which can take place.

SUMMARY OF THE INVENTION

It is an aim of the present invention to at least partly mitigate the above-mentioned problems.

It is an aim of certain embodiments of the present invention to provide a scalable deposit module which is able to maintain and process more than fifty items of media in an aligned bunch.

It is an aim of certain embodiments of the present invention to provide a method and apparatus which can receive items of media one-by-one and bunch them in an aligned bunch whereby the opportunity for the apparatus to malfunction and become stuck with misaligned items of media is much reduced relative to prior known devices.

According to a first aspect of the present invention there is provided an apparatus for providing an aligned bunch of items of media, comprising:

a driven drum element arranged to rotate about a drum axis of rotation; and at least one driven endless belt member each arranged along a respective belt pathway, the belt pathway comprising a pathway portion in which the belt member extends in a cooperating relationship with more than sixty percent of the circumference of an outer surface of the drum element; wherein the drum element and said at least one belt member co-operate to receive and align items of media therebetween.

Aptly, the pathway portion comprises at least about around seventy to eighty percent of the circumference of an outer surface of the drum element.

Aptly, the apparatus comprises only one transfer point region.

Aptly, the apparatus comprises only one item input path leading to the transfer point region; and only one item output path leading from the transfer point region; wherein the input path is arranged for selectively introducing items of media one-by-one to the pathway portion and said output path is arranged for selectively discharging a single item of media or an aligned bunch of media from the pathway portion.

Aptly, the apparatus comprises at least one guide element selectively locatable in a stack position in which items of media are rotated about the drum, and an exit position in which an item of media or stack of items are discharged to a disposal slot.

Aptly, an angle of attack of a guide element relative to the drum element is selected responsive to a determined number of items of media.

Aptly, a driven drum element and the driven endless belt member are rotatable at different speeds and/or the speed of rotation of the drum element and/or the speed of rotation of the endless belt member is responsive to a determined number of items of media.

Aptly, each endless belt member is guided around a plurality of respective pulley elements, at least one pulley element being located or resiliently biaised relative to the drum element so as to constantly urge a belt pathway portion of the endless belt towards the outer surface of the drum element.

Aptly, the apparatus comprises a rebuncher element of an automatic teller machine (ATM), and each said item of media comprises a currency note or check.

Aptly, said at least one guide element comprises a guide finger member comprising, at a first end region thereof, an abutment surface and a pulley element arranged to locate a belt pathway; wherein the guide finger member is rotatable about a pivot point at a further end region thereof, the stack position of the guide element corresponding to the finger member being rotated towards the drum member to locate the abutment surface and belt member proximate to the drum member, the exit position of the guide element corresponding to the finger member being rotated away from the drum member to locate the abutment surface and belt member distal to the drum member.

Aptly, said at least one guide element comprises a guide arm comprising a first and second abutment surface at a first end region thereof, said guide arm being rotatable about a pivot point at a further end region thereof, the stack position of the guide element corresponding to the guide arm being rotated away from the drum member to locate the first abutment surface in a position to guide input items of media, the exit position of the guide element corresponding to the guide arm being rotated towards the drum member to locate the second abutment surface in a position to guide discharging items of media.

According to a second aspect of the present invention there is provided a method of providing an aligned stack of items of media, the method comprising the steps of:

rotating a drum element comprising a cylindrical outer surface about a drum axis of rotation;

rotating at least one endless belt member along a respective belt pathway, said pathway comprising a pathway portion which extends in a co-operating relationship with more than sixty percent of the circumference of the outer surface;

receiving items of media one-by-one between the belt member and drum element; and stacking said received items in an aligned bunch prior to discharge.

Aptly, the method includes the steps of receiving each item of media at a pre-determined point in time whereby a newly introduced item is located on top of a previously located item to thereby form a bunch; and rotating a radially inner portion of a bunch slower than a radially outer portion of the bunch to thereby maintain the bunch in an aligned bunch configuration.

Aptly, the method includes the step of one or more support items of media between the endless belt and the drum for about around seventy to eighty percent of the circumference of the outer surface.

According to a third aspect of the present invention there is provided a product which comprises a computer program comprising instructions for rotating a drum element comprising a cylindrical outer surface about a drum axis of rotation, rotating at least one endless belt member along a respective belt pathway, said pathway comprising a pathway portion which extends in a co-operating relationship with more than sixty percent of the circumference of the outer surface, receiving items of media one-by-one between the belt member and drum element, and stacking said received items in an aligned bunch prior to discharge.

Certain embodiments of the present invention provide the advantage that a drum and belt member in a rebunching unit co-operate to such an extent that items of media may be stacked in a highly aligned fashion without splay or skew. This minimizes the risk of malfunction of the rebunching unit and additionally, helps return a bunch of items of media in an aligned fashion to a customer.

Certain embodiments of the present invention provide the advantage that large bunches of items of media such as currency notes or checks or the like may be processed in a scalable deposit module. This improves versatility for customers and reduces processing time which reduces a chance of failure and improves customer experience.

Certain embodiments of the present invention produce an almost constant motivational force on documents being processed in a rebunching unit. This allows much better control of the splay on a leading edge region of the document bunch.

Certain embodiments of the present invention provide guide elements which guide items of media as they enter and circulate in a rebunching unit and which guide a bunch of items of media as they leave a rebunching unit, whereby the guidance provided by the guide elements is tailored to the number of items of media. Controlling deflection of the guide fingers helps maintain a controlled gap between a drum and the circulating items at a transfer point. This helps maintain a bunch of items of media in an aligned manner.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
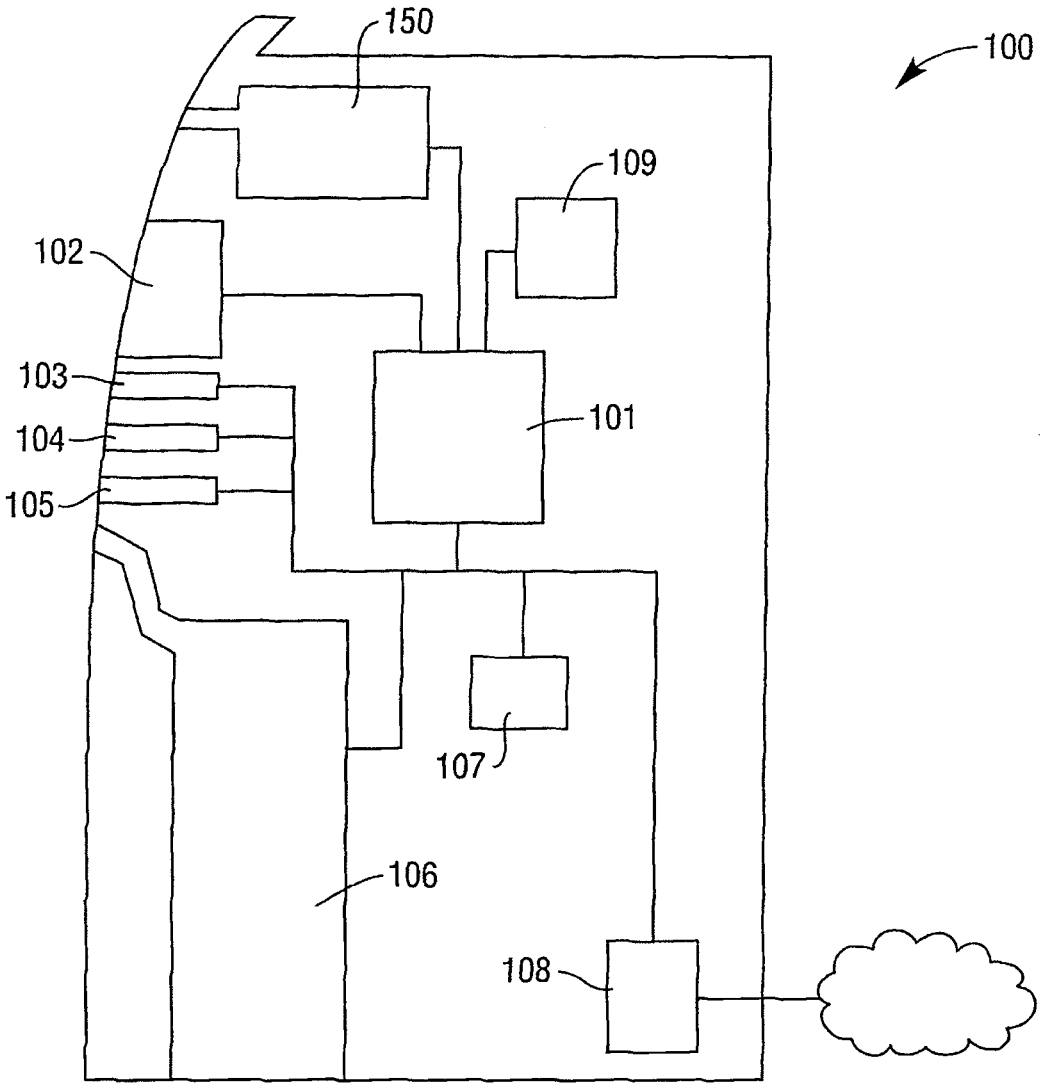
FIG. 1 is a schematic diagram of an ATM.

In the drawings like reference numerals refer to like parts.

FIG. 1 illustrates a block diagram of a self-service terminal 100 in the form of an automated teller machine (ATM) according to one embodiment of the present invention. It will be understood that certain embodiments of the present invention are applicable to other types of terminal such as ATMs, vending machines, change machines and the like.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by a service operator (such as a field engineer, a replenisher (of currency, of printed paper or the like), or the like).

Certain customer transaction modules (such as the ATM controller 101) are also used by the service personnel for implementing management functions. However, some of the modules are referred to herein as service personnel modules (such as the journal printer module 107 and the operator panel module 109) because they are never used by ATM customers.

FIG. 1 also illustrates a schematic diagram of a scalable deposit module 150 according to one embodiment of the present invention. The deposit module 150 is operable to receive bunches of items of media such as currency notes, bank notes and/or checks from a customer. These can be stored securely or returned to a customer.

Figure 2:
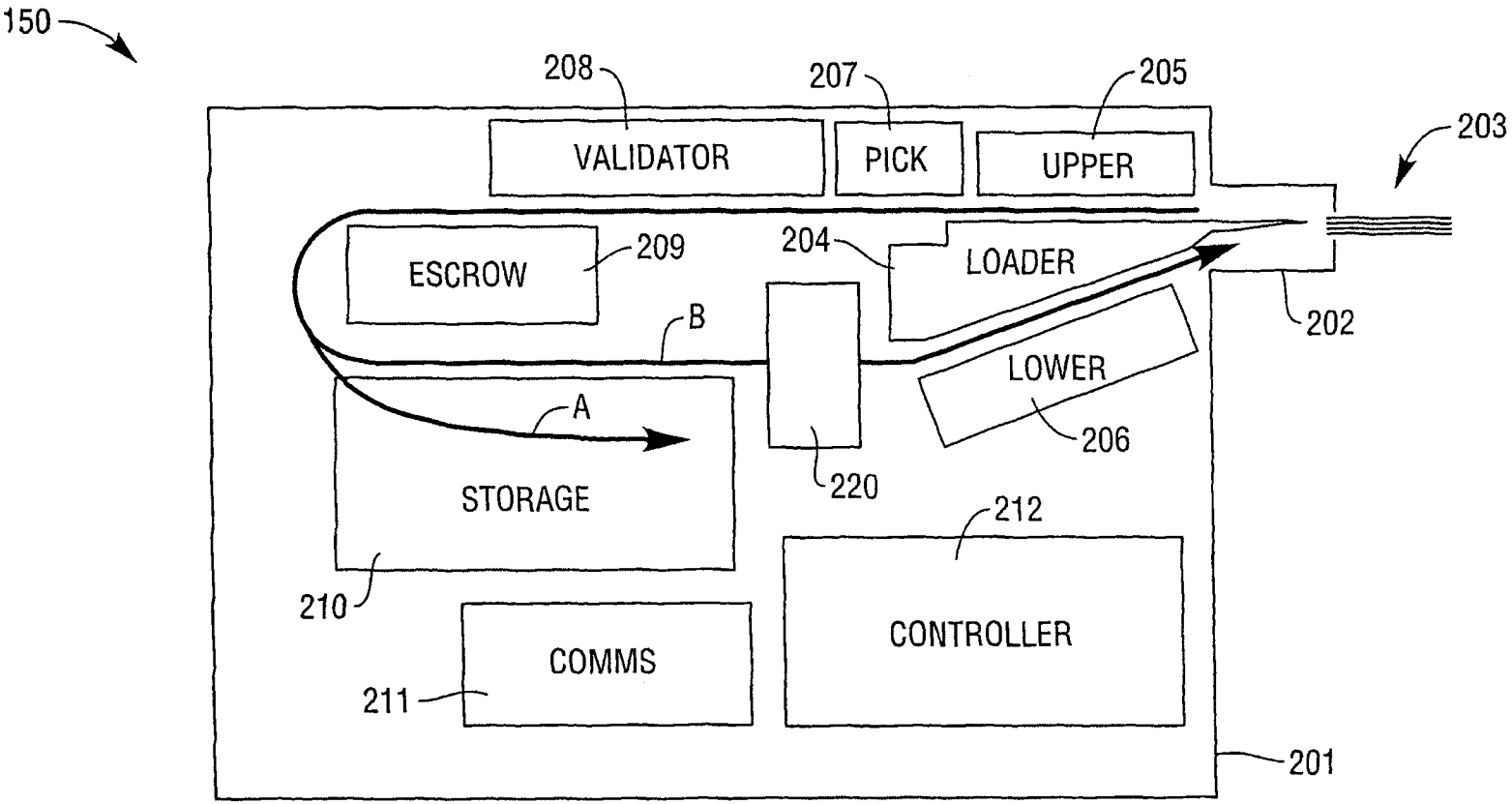
FIG. 2 is a schematic diagram of a bunch sheet depository according to one embodiment of the present invention.

The depository is shown in more detail in FIG. 2 and includes a chassis 201 onto which various parts are mounted. The depository 150 further includes a bunch deposit slot 202 at which a customer (not shown) can introduce a bunch 203 of currency notes or other such items of media. This enables the sheet items of media to be deposited by a customer. A bunch loader 204 co-operates with an upper loading unit 205 and a lower dispatch unit 206. These co-operate to receive the bunch of items of media and move them to a pick unit 207 or return them to a customer via slot 202 respectively. The pick unit 207 is aligned with the bunch loader 204 for removing individual sheets from the bunch of sheets 203. A sheet validator 208 determines whether the items of media are valid. An escrow 209 is provided for temporarily storing validated sheets until a customer confirms they wish to complete a transaction. A storage compartment 210 is provided as well as a communication circuit board 211 for communicating with the self-service terminal into which the depository 15 may be installed. An on-board controller 212 is provided for controlling the operation of the depository 150.

The depository 150 includes a plurality of transport units only some of which are described herein. An upper sheet transport section 205 is located above the bunch loader and adjacent to the picker 207. A lower sheet transport section 206 is located beneath the bunch loader 204 and near the bunch deposit slot 202.

The bunch loader 204 is used to transport deposited bank notes from the bunch deposit slot 202 to the pick unit 207.

There are two different routes that can be taken by an item of media that is inserted into the depository 150. A first route is shown by arrow A and involves the sheet item being picked from the bunch of sheets 203, transported to the picker unit 207, moved past the validator 208 to be identified and validated, placed in the escrow 209 and from the escrow 209 transported into the storage compartment 210.

The second optional route is shown by the arrow B and involves the sheet item being picked from the bunch of sheets 203, transported to the picker unit 207, moved past the validator 208 to be identified and validated, placed in the escrow 209 and from the escrow 209 returned to the customer via a rebunching unit 220 and via the loading unit 204 and lower transport section 206.

As will be understood by those skilled in the art, whether a sheet item is stored (that is to say, follows the route shown by arrow A) or returned to a customer (that is to say, follows a path shown by arrow B) depends on a number of factors, such as whether the sheet is recognized, whether a sheet is validated and/or whether a customer cancels or confirms a transaction or the like.

Figure 3:
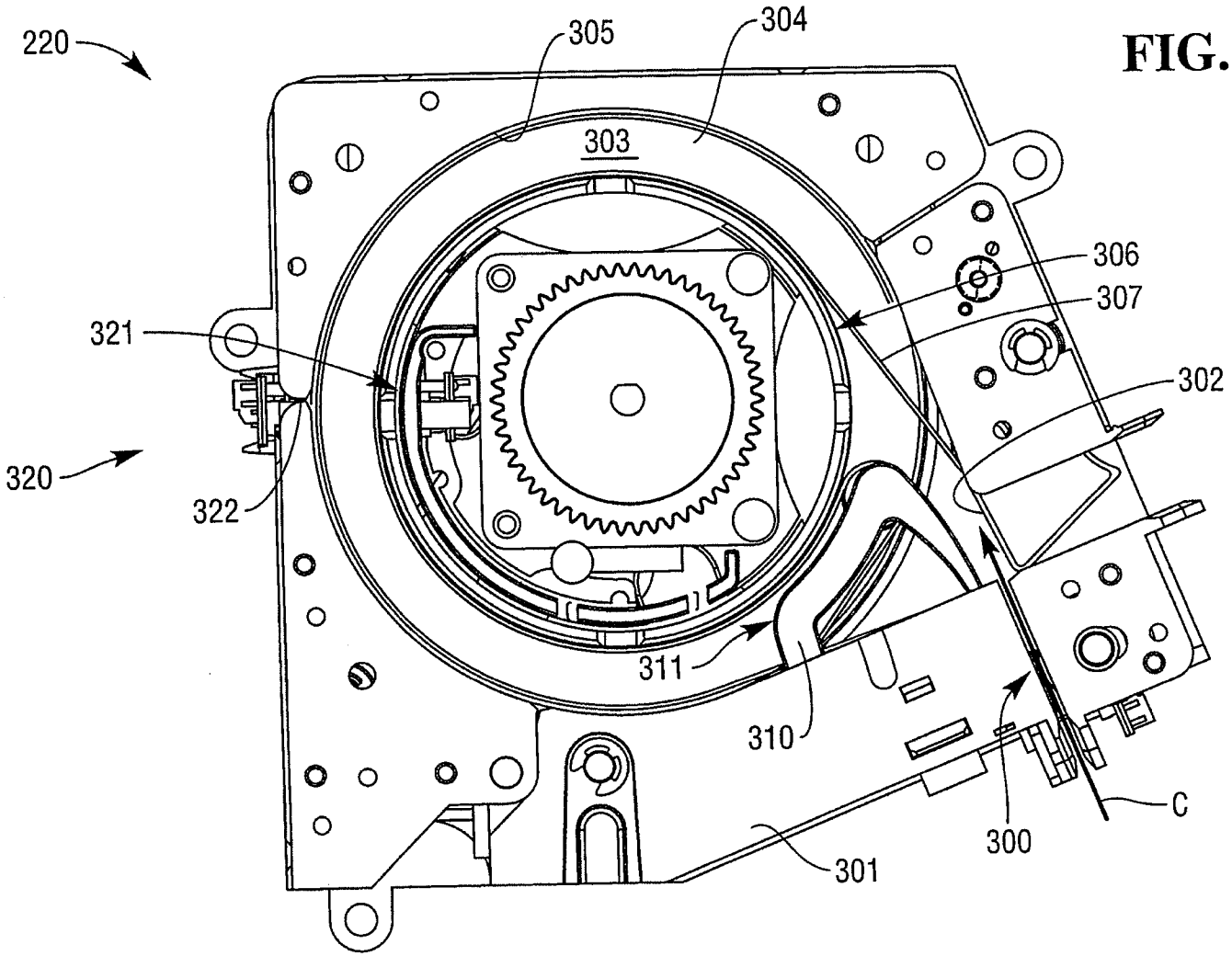
FIG. 3 is a view of a rebunching unit in an input mode of operation.

FIG. 3 illustrates parts of the rebuncher unit 220 in more detail and illustrates part of the pathway followed by items of media which are to be returned to a customer via slot 202. That is to say, part of pathway shown by arrow B in FIG. 2. Items of media such as currency notes are input at arrow C shown in FIG. 3 and enter through slit 300 in casing 301. The input items of media are guided by an abutment surface 302 of a guide arm and continue into a space 303 which is generally circular in cross section and which is formed between a transparent drum 304 and various parts of the housing. The transparent drum is a substantially cylindrical element like a barrel which rotates about a longitudinal axis. The space has an inner surface 305 at an outer circumference and an inner surface defined by an outer surface 306 of the drum at a radially innermost position.

An endless belt 307 is located at a position to help direct incoming items of media into position within the space 303. In the FIG. 3 illustration, it can be seen that the endless belt 307 is engaged against the outer surface 306 of the rotating drum. A first item of media incoming along the pathway shown by arrow C, is thus directed into a position between an inner surface of the endless belt and the outer surface 306 on the drum.

The drum and endless belt rotate and are urged together by virtue of the positioning and material of the endless belt so as to co-operate to carry items of media therebetween as the drum and endless belt rotate.

Also indicated in FIG. 3 is a further guide element 310 which is an elongate finger having an abutment surface 311 for directing items of media in the circulating space 303 which are rotating in an anti-clockwise fashion. The guide finger 310 also carries a pulley (not shown) which locates an extreme end of the pathway of the endless belt 307. That is to say, with the guide finger in the position shown in FIG. 3, the endless belt has a pathway set by the position of the pulley carried by the finger which is duly located to urge the endless belt against the outer surface 306 of the drum. Thus, items of media introduced between the co-operating endless belt and drum rotate in a counter-clockwise motion and are supported in a co-operating fashion between the drum and the endless belt for virtually all of the circumference of the inner surface of the drum. Aptly, the endless belt and drum co-operate over sixty percent or more of the circumference of the surface of the drum. Aptly, the endless belt and drum co-operate over more than eighty percent of the circumference of the endless belt. Aptly, the endless belt and drum co-operate at about around sixty to eighty five percent of the circumference of the drum.

Also shown in FIG. 3 is a position sensor 320 which includes an illumination emitting device 321 and corresponding illumination receiving device 322. Because the drum is manufactured from a substantially or wholly transparent material, illumination such as visible light or infrared light or the like can be transmitted between the emitting device and detecting sensor so that as notes or other items rotate about the drum leading edges or trailing edges or other edges of the currency note can be detected. Such information is used for synchronization purposes. As will be described hereinafter in more detail, the belt whilst passing substantially around the circumference of the drum does not extend along the whole longitudinal axial length of the drum. Rather, one, two or more belts are utilized which helps prevent splay and skew in the circulating items of media and which enables the detector to operate as described.

Figure 4:
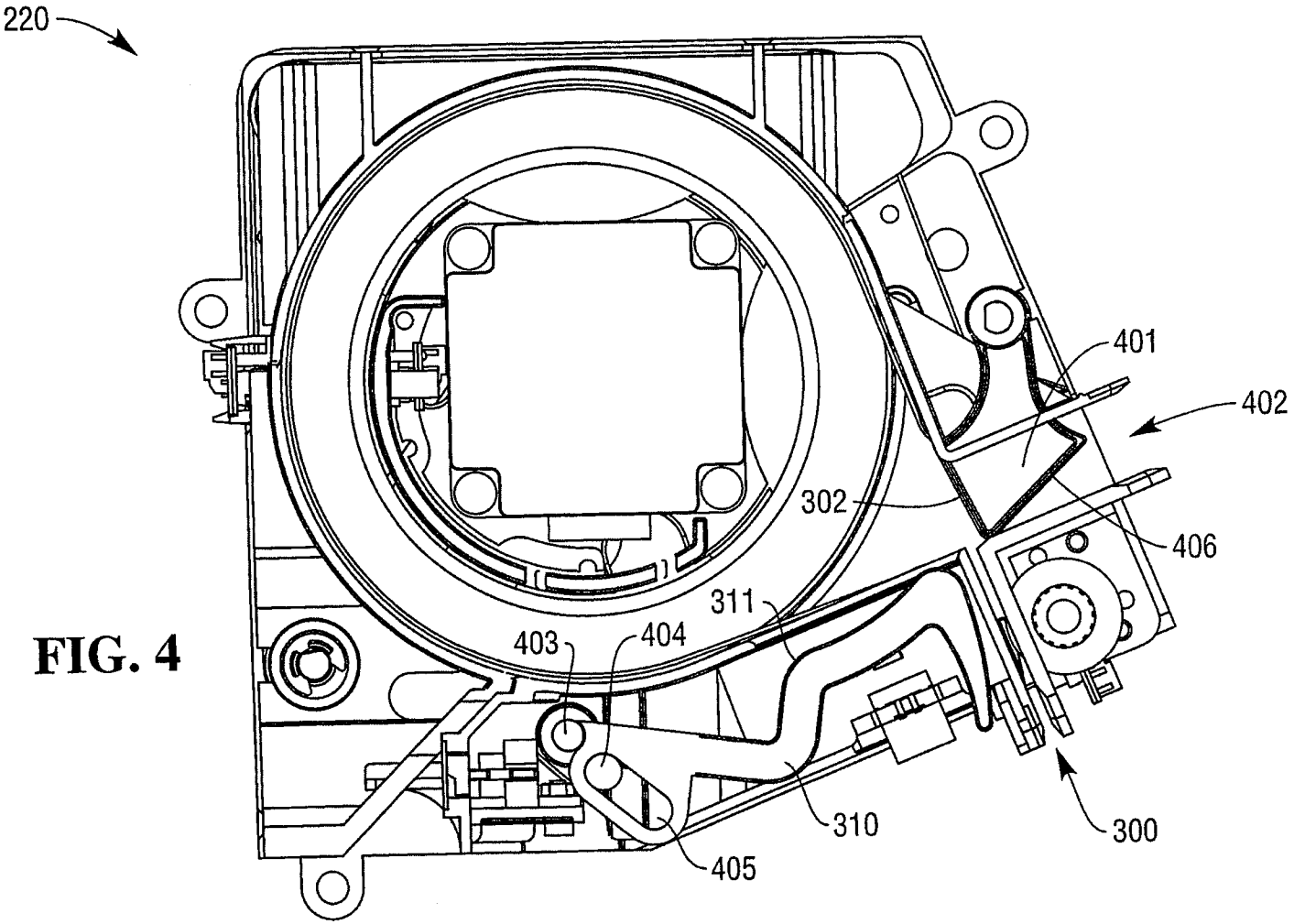
FIG. 4 illustrates the rebunching unit with circulating items of media at the initiation of an exit or dispatch mode of operation.

FIG. 4 illustrates the rebuncher 220 in a further mode of operation in which items of media such as currency notes, checks or the like have been introduced through slot 300 and stacked in a bunch in the rebuncher unit 220. It will be noticed in FIG. 4 that the endless belt is now shown in a radially expanded position. That is to say, the endless belt is now almost extended to the extremities of the space 303. This is indicative of the state of affairs when a large bunch of items of media has been collected one-by-one and is rotating within the rebuncher prior to dispatch. In order to eject the aligned stack from the rebunching unit 220, the guide finger 310 and guide arm 401 carrying the abutment surface 302 must be relocated from a stack position in which items of media are rotated about the drum to an exit position in which an item of media or a bunch of items are discharged to a disposal slot 402.

As illustrated in FIG. 4, the finger is urged into an exit position (shown in FIG. 4) by pivoting about a pivot point 403. This is achieved by sliding a pin 404 within an angled elongate recess 405 at an end of the finger body.

Figure 5:
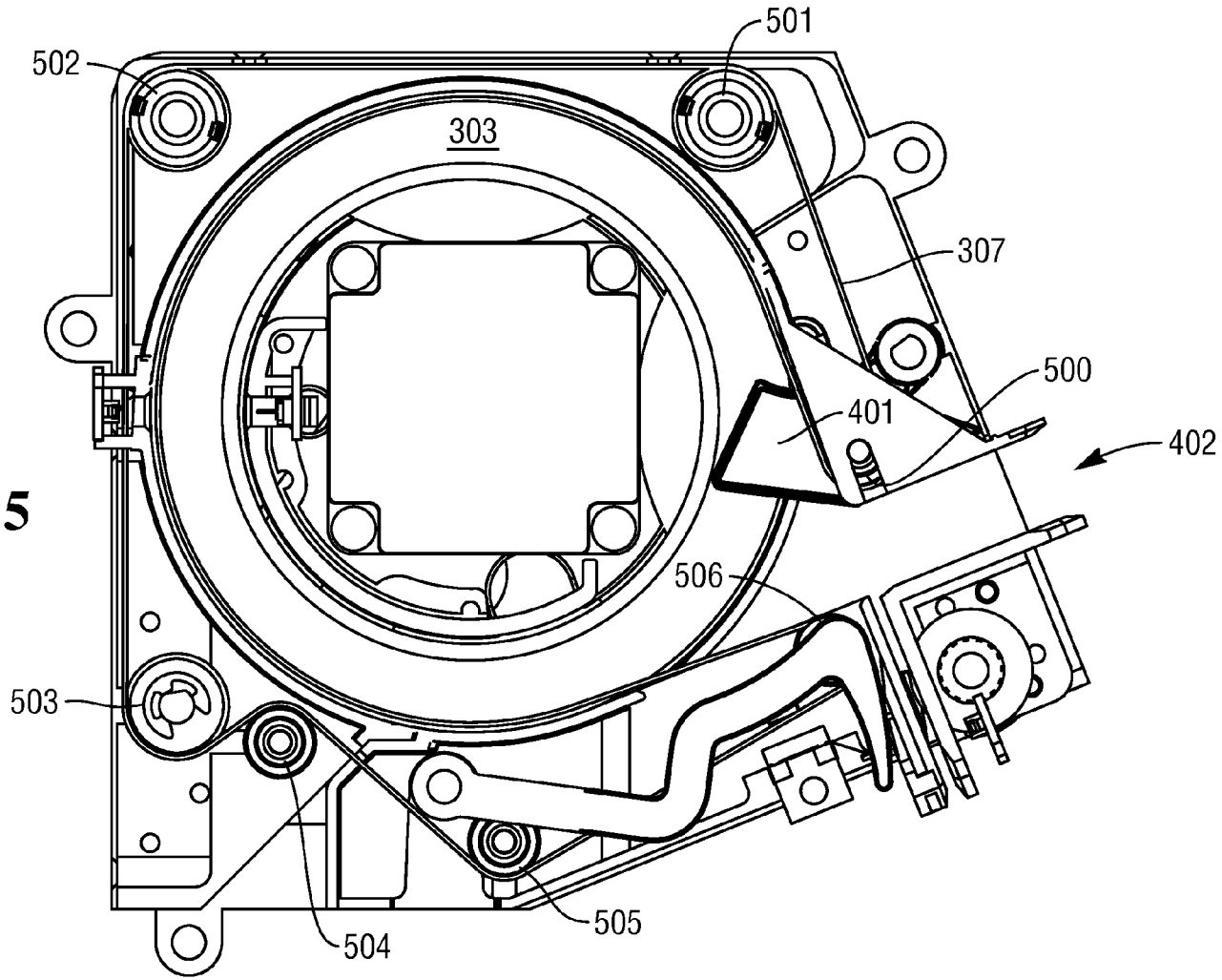
FIG. 5 illustrates motion of a guide arm prior to dispatch of items of media.

FIG. 4 also illustrates in cut away mode how the guide arm 401 has a first abutment surface 302 which helps guide incoming items of media in a stacking mode of operation, together with a further abutment surface 406 which has an operation shown in more detail in FIG. 5.

FIG. 5 illustrates the pathway of the endless belt 307 in more detail. The pathway has a fixed extremity defined by a first pulley 500 (only partially shown) which is fixed in place but is rotatable thereat. The endless belt also passes around a further pulley 501 shown in the top right hand corner of FIG. 5 and around a still further pulley 502 located in the top left hand corner of FIG. 5. A further lower pulley 503 and minor pulley 504 are illustrated in the bottom left hand corner of FIG. 5 and a still further lower pulley 505 defines a lower extremity for the belt pathway. These pulleys are fixed in position but are rotatable to allow the endless belt to rotate. The pulleys may rotate freely or one or more are driven at a controlled speed.

As illustrated in FIG. 5, a still further guide pulley 506 is carried by the positionable guide finger 310. This pulley 506 defines an end region of the pathway defined for the belt. The other portion of the belt pathway is defined by the outer surface of the drum member or an outer surface of any items of media carried between the drum and belt and are thus bunched within the enclosure 303.

As illustrated in FIG. 5, the guide arm 401 is locatable in an exit position in which a lower abutment surface 406 is brought into a position so that circulating items of media will be guided by that surface towards the exit orifice 402. Items of media ejected from this exit orifice 402 will be transferred to the loader 204 and lower transport unit 206 for ultimate ejection at the slot 202 of the ATM as a bunch.

Figure 6:
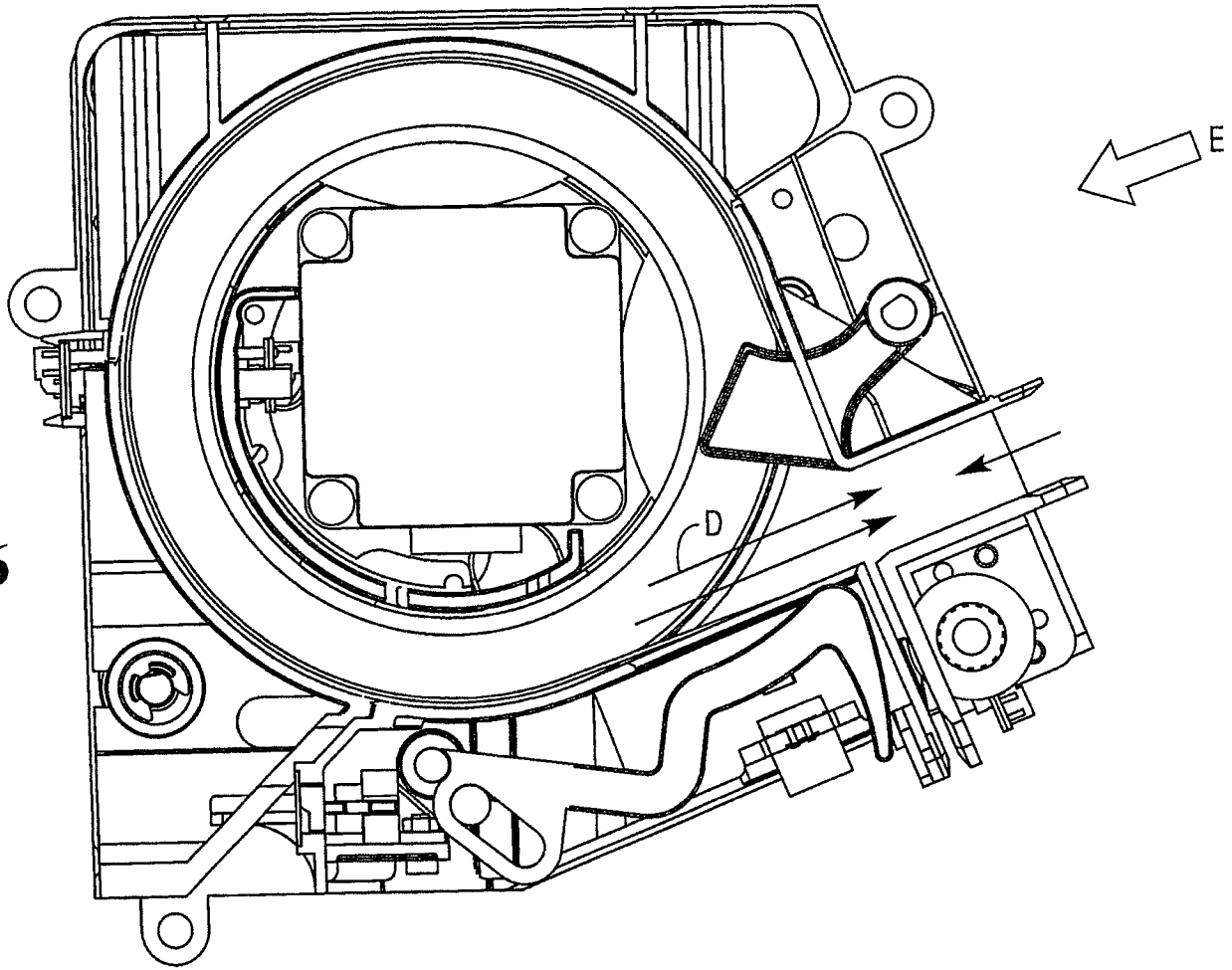
FIG. 6 illustrates the location of guide elements as items of media are dispatched from the rebunching unit.

FIG. 6 illustrates the ejection of items of media in a bunch along the direction of arrows D. The bunch of items which have been accumulated in a circulating fashion between an outer surface of the drum and the endless belt, thus begin to move off as they separate from the outer surface of the drum are moved as a bunch into the exit orifice 402.

Figure 7:
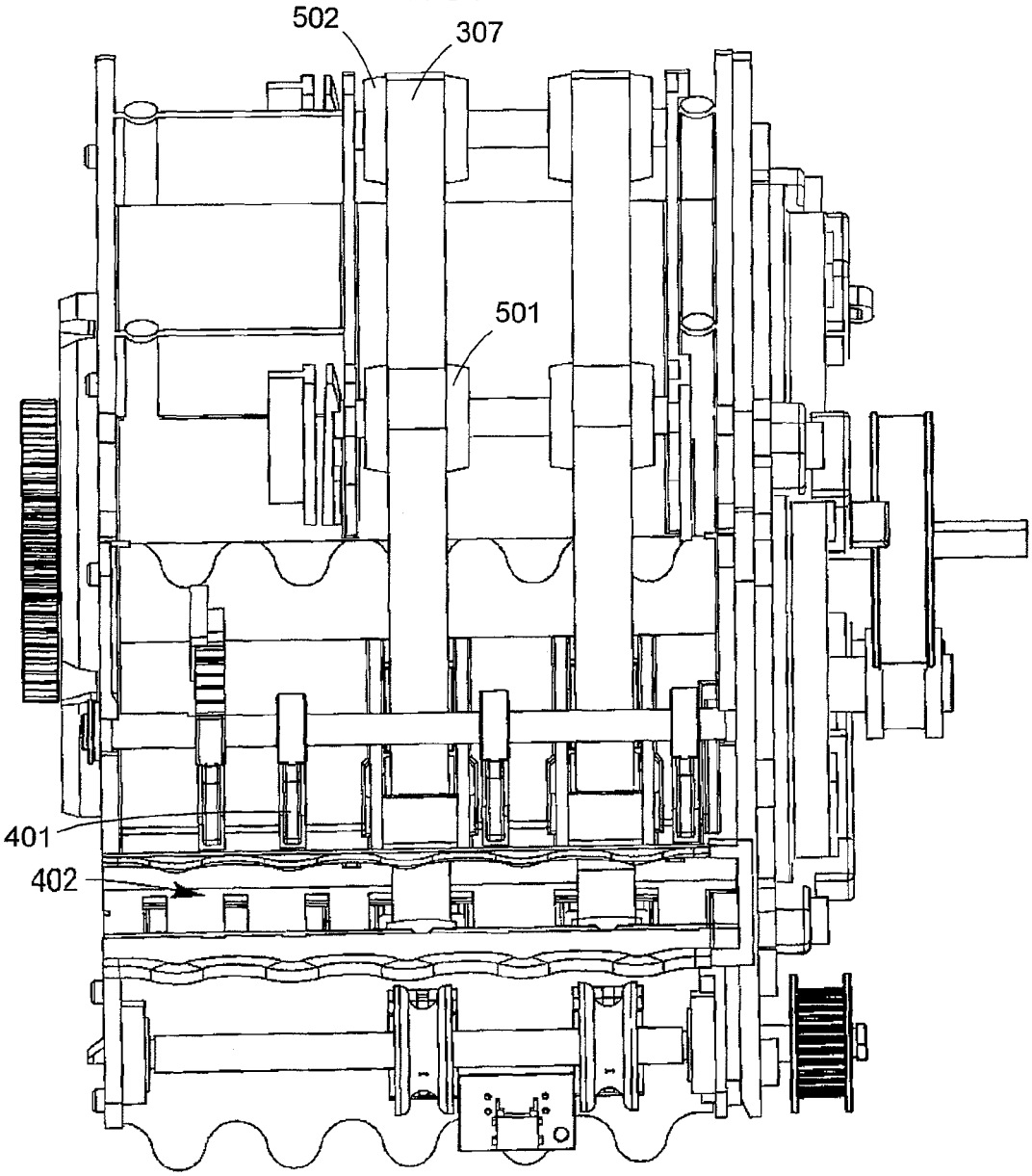
FIG. 7 illustrates a view from the direction shown by arrow E, in FIG. 6, of parts of a rebunching unit.

FIG. 7 illustrates a view of the rebuncher unit 220 with the view being taken in the direction of the arrow E shown in FIG. 6. Sheet items of media are ejected through the orifice 402 in an out-of-the-page direction. FIG. 7 helps clarify that whilst two or more endless belts may be arranged in a side-by-side substantially parallel fashion, each belt nevertheless is arranged as shown in FIGS. 3 to 6 so as to extend substantially around more than sixty percent of the outer surface of the drum. Having two or more endless belts arranged in a parallel configuration helps reduce the risk of skew when two or more items of media are stacked in a bunch and rotated in a circulating fashion between the endless belts and the drum.

It will be appreciated that when only one item of media is present between an outer surface of the drum and the endless belt, then the endless belt rotates about a pathway portion substantially defined by the outer surface of the drum. However, as more and more items of media are added, an outer surface of the outermost item of media in the bunch of items of media becomes the surface against which the endless belt is driven. As more and more items are added to the bunch, the radius of curvature followed by the endless belt relative to the central longitudinal axis of rotation of the drum increases. Thus, in order to keep the items of media which are radially innermost rotating at an effective same pace as items of media which are radially outside those inner items, then the effective speed of rotation must be altered. Thus, the endless belt is driven at a pace which is quicker than the effective pace of the drum. This can be achieved in a number of ways, for example, by fixing a speed of rotation of the endless belt and slowing down a speed of rotation of the drum as items of media are added. A combination of speeding up and slowing down the belt and/or drum may also optionally be utilized. Aptly, the respective speeds of the drum and belt are incremented as each new item of media is added into the rebunching unit and thus the distance of a rotation path of the endless belt and outer surface of the drum increases.

By controlling the expected rotation rates in this manner, a large bunch of items of media can be stacked in the rebunching unit and kept in an aligned format. Aptly, up to one hundred currency notes or other such sheet items of media can be kept in an aligned stack without severe risk of splay or skew outside of tolerable limits.

Certain embodiments of the present invention thus provide a rebunching unit which is able to be used in a scalable deposit module. This can be used as a replacement for prior known two-belt rebunchers where two belts are needed to support circulating items of media between the belt and a drum. By having only one transfer point, that is to say, one region where the items of media are not supported between a belt and a drum surface, then splay and skew of currency units can be much reduced or wholly eliminated.

The single belt rebunching unit described hereinabove (although more than one belt can be used in a side-by-side configuration) is helpful to produce a more constant motivational force on notes and other such sheet items. This allows better control of the splay on the leading edge of any bunch. Items of media are wound around a central hub by the use of belts, each covering a separate (in a longitudinal sense) portion of the drum.

By urging a single belt which encompasses approximately around seventy five percent of a drum surface against an outer document in a bunch, while maintaining the speed of the inner documents by also driving the drum, certain embodiments of the present invention provide a distinct advantage relative to prior known techniques. A speed of both the belt and drum may be controlled by software or the like, allowing "soft" control over the splay of documents. Retaining fingers which guide the items of media are utilized to keep the documents close to the rotating drum where there is no belt contact. By fixing a deflection of these guide fingers a controlled gap can be maintained between the drum and the circulating items during this unsupported region. This allows new notes or checks to be added to a bunch but without risk of splay or skew. By adjusting a speed of both the drum for the innermost documents and the belt for the outer documents, splay can be controlled in a predictable fashion. Aptly, the speed of rotation is adjusted for a drum motor every time a document is added to allow for the increasing outer diameter. The belt motor may maintain a constant speed. This has very favorable effects.

Certain embodiments of the present invention provide a solution which includes only one document transfer point to and from the same belt. This reduces the risk of sheet item splay on a bunch of sheet items.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. Apparatus for providing an aligned bunch of items of media, comprising:

a driven drum element arranged to rotate about a drum axis of rotation; and at least one driven endless belt member each arranged along a respective belt pathway, the belt pathway comprising a pathway portion in which the belt member extends in a cooperating relationship with more than sixty percent of the circumference of an outer surface of the drum element; wherein the drum element and said at least one belt member cooperate to receive and align items of media therebetween;

the driven drum element and said driven endless belt member are rotatable at different speeds and/or the speed of rotation of the drum element and/or the speed of rotation of said endless belt member is responsive to a determined number of items of media.

2. Apparatus as claimed in claim 1, wherein:

the pathway portion comprises at least about around seventy to eighty percent of the circumference of an outer surface of the drum element.

3. The apparatus as claimed in claim 1, further comprising only one transfer point region.

4. The apparatus as claimed in claim 3, further comprising:

only one item input path leading to the transfer point region; and only one item output path leading from the transfer point region; wherein the input path is arranged for selectively introducing items of media one-by-one to the pathway portion and said output path is arranged for selectively discharging a single item of media or an aligned bunch of media from the pathway portion.

5. The apparatus as claimed in claim 1, further comprising:

at least one guide element selectively locatable in a stack position in which items of media are rotated about the drum, and an exit position in which an item of media or bunch of items are discharged to a disposal slot.

6. Apparatus for providing an aligned bunch of items of media, comprising:

a driven drum element arranged to rotate about a drum axis of rotation; and at least one driven endless belt member each arranged along a respective belt pathway, the belt pathway comprising a pathway portion in which the belt member extends in a cooperating relationship with more than sixty percent of the circumference of an outer surface of the drum element; wherein the drum element and said at least one belt member cooperate to receive and align items of media therebetween;

at least one guide element selectively locatable in a stack position in which items of media are rotated about the drum, and an exit position in which an item of media or bunch of items are discharged to a disposal slot;

an angle of attack of the guide element relative to the drum element is selected, responsive to a determined number of items of media.

7. Apparatus for providing an aligned bunch of items of media, comprising:

a driven drum element arranged to rotate about a drum axis of rotation; and at least one driven endless belt member each arranged along a respective belt pathway, the belt pathway comprising a pathway portion in which the belt member extends in a cooperating relationship with more than sixty percent of the circumference of an outer surface of the drum element; wherein the drum element and said at least one belt member cooperate to receive and align items of media therebetween;

each endless belt member is guided around a plurality of respective pulley elements, at least one pulley element being located or resiliently biaised relative to the drum element so as to constantly urge a belt pathway portion of the endless belt towards the outer surface of the drum element.

8. The apparatus as claimed in claim 1 wherein the apparatus further comprises a rebuncher element of an automatic teller machine (ATM), and each said item of media comprises a currency note or check.

9. Apparatus for providing an aligned bunch of items of media, comprising:

a driven drum element arranged to rotate about a drum axis of rotation; and at least one driven endless belt member each arranged along a respective belt pathway, the belt pathway comprising a pathway portion in which the belt member extends in a cooperating relationship with more than sixty percent of the circumference of an outer surface of the drum element; wherein the drum element and said at least one belt member cooperate to receive and align items of media therebetween;

at least one guide element selectively locatable in a stack position in which items of media are rotated about the drum, and an exit position in which an item of media or bunch of items are discharged to a disposal slot;

said at least one guide element comprises a guide finger member comprising, at a first end region thereof, an abutment surface and a pulley element arranged to locate a belt pathway; wherein the guide finger member is rotatable about a pivot point at a further end region thereof, the stack position of the guide element corresponding to the finger member being rotated towards the drum member to locate the abutment surface and belt member proximate to the drum member, the exit position of the guide element corresponding to the finger member being rotated away from the drum member to locate the abutment surface and belt member distal to the drum member.

10. The apparatus as claimed in claim 5, further comprising:

said at least one guide element comprises a guide arm comprising a first and second abutment surface at a first end region thereof, said guide arm being rotatable about a pivot point at a further end region thereof, the stack position of the guide element corresponding to the guide arm being rotated away from the drum member to locate the first abutment surface in a position to guide input items of media, the exit position of the guide element corresponding to the guide arm being rotated towards the drum member to locate the second abutment surface in a position to guide discharging items of media.

11. A method of providing an aligned bunch of items of media, the method comprising the steps of:

rotating a drum element comprising a cylindrical outer surface about a drum axis of rotation;

rotating at least one endless belt member along a respective belt pathway, said pathway comprising a pathway portion which extends in a co-operating relationship with more than sixty percent of the circumference of the outer surface;

receiving items of media one-by-one between the belt member and drum element;

stacking said received items in an aligned bunch prior to discharge;

receiving each item of media at a pre-determined point in time whereby a newly introduced item is located on top of a previously located item to thereby form a bunch; and rotating a radially inner portion of a bunch slower than a radially outer portion of the bunch to thereby maintain the bunch in an aligned bunch configuration.

12. The method as claimed in claim 11, further comprising the step of:

supporting one or more items of media between the endless belt and the drum for about around seventy to eighty percent of the circumference of the outer surface.

13. A program storage medium readable by a computer having a memory, the medium tangibly embodying one or more programs of instructions executable by the computer to perform the method steps of claim 11.

14. The apparatus as claimed in claim 6 wherein the apparatus further comprises a rebuncher element of an automatic teller machine (ATM), and each said item of media comprises a currency note or check.

15. The apparatus as claimed in claim 7 wherein the apparatus further comprises a rebuncher element of an automatic teller machine (ATM), and each said item of media comprises a currency note or check.

16. The apparatus as claimed in claim 9 wherein the apparatus further comprises a rebuncher element of an automatic teller machine (ATM), and each said item of media comprises a currency note or check.

* * * * *